US008941577B2

(12) United States Patent
Ohara

(10) Patent No.: US 8,941,577 B2
(45) Date of Patent: Jan. 27, 2015

(54) LIQUID CRYSTAL DISPLAY WITH DUMMY STAGES IN SHIFT REGISTER AND ITS CLOCK SIGNAL OPERATION

(75) Inventor: Masanori Ohara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 93 days.

(21) Appl. No.: 13/879,992

(22) PCT Filed: Nov. 2, 2011

(86) PCT No.: PCT/JP2011/075267

§ 371 (c)(1),
(2), (4) Date: Apr. 17, 2013

(87) PCT Pub. No.: WO2012/063696

PCT Pub. Date: May 18, 2012

(65) Prior Publication Data

US 2013/0201090 A1 Aug. 8, 2013

(30) Foreign Application Priority Data

Nov. 10, 2010 (JP) ..... 2010-251578

(51) Int. Cl.
*G09G 3/36* (2006.01)
*G09G 3/20* (2006.01)

(52) U.S. Cl.
CPC ..... *G09G 3/20* (2013.01); *G09G 3/3677* (2013.01); *G09G 3/2092* (2013.01); *G09G 2300/0408* (2013.01); *G09G 2300/0426* (2013.01); *G09G 2300/0447* (2013.01); *G09G 2300/0876* (2013.01); *G09G 2310/0286* (2013.01);

(Continued)

(58) Field of Classification Search
USPC ..... 345/87–104, 211–213, 690–696; 315/169.2
See application file for complete search history.

(56) References Cited

U.S. PATENT DOCUMENTS

2003/0227429 A1 12/2003 Shimoshikiryo
2007/0008268 A1* 1/2007 Park et al. ..... 345/92
2007/0070008 A1 3/2007 Shin et al.

(Continued)

FOREIGN PATENT DOCUMENTS

JP 2004-062146 A 2/2004
JP 2007-086791 A 4/2007
JP 2008-145886 A 6/2008

OTHER PUBLICATIONS

International Search Report and Written Opinion corresponding to PCT/JP2011/075267, dated Feb. 7, 2012.

(Continued)

*Primary Examiner* — Chanh Nguyen
*Assistant Examiner* — Sanghyuk Park
(74) *Attorney, Agent, or Firm* — Lowe Hauptman & Ham, LLP

(57) ABSTRACT

A first gate driver that drives a gate bus line corresponding to a first sub-pixel section and a second gate driver that drives a gate bus line corresponding to a second sub-pixel section are monolithically formed inside a panel. A shift register inside the second gate driver has a configuration where stages corresponding to respective rows and dummy stages each disposed for each row, are connected in series with one another. In such a configuration, a frequency of a clock signal for controlling an operation of the second gate driver is made twice as large as a frequency of a clock signal for controlling an operation of the first gate driver.

4 Claims, 14 Drawing Sheets

(52) U.S. Cl.
CPC .... *G09G2310/0291* (2013.01); *G09G 2310/08* (2013.01); *G09G 2320/028* (2013.01)
USPC ..... 345/100; 345/99

(56) References Cited

U.S. PATENT DOCUMENTS

2007/0132700 A1* 6/2007 Cho et al. ..... 345/100
2007/0216634 A1* 9/2007 Kim et al. ..... 345/100
2008/0012842 A1* 1/2008 Mori ..... 345/206
2008/0211760 A1* 9/2008 Baek et al. ..... 345/98
2008/0266477 A1* 10/2008 Lee et al. ..... 349/46
2010/0085335 A1* 4/2010 Kato ..... 345/204
2010/0156858 A1* 6/2010 Moon et al. ..... 345/204
2010/0156869 A1* 6/2010 Lee et al. ..... 345/208
2010/0201666 A1* 8/2010 Tobita ..... 345/208
2011/0102389 A1* 5/2011 Park et al. ..... 345/205
2011/0267326 A1* 11/2011 Kim et al. ..... 345/211

OTHER PUBLICATIONS

Min-Cheol Lee et al., "55.3: Driving Method of Integrated Gate Driver for Large Area LCD-TV", SID 08 Digest, pp. 838-841 (2008).

* cited by examiner

| | NUMBER OF GATE-DRIVER IC CHIPS | NUMBER OF SOURCE-DRIVER IC CHIPS |
|---|---|---|
| CONVENTIONAL 2G-1D CONFIGURATION | 2p | q |
| CONVENTIONAL 1G-2D CONFIGURATION | p or 0 | 2q |
| PRESENT EMBODIMENT | 0 | q |

LIQUID CRYSTAL DISPLAY WITH DUMMY STAGES IN SHIFT REGISTER AND ITS CLOCK SIGNAL OPERATION

RELATED APPLICATIONS

The present application is a National Phase of International Application Number PCT/JP2011/075267, filed Nov. 2, 2011, and claims priority from Japanese Application Number 2010-251578, filed Nov. 10, 2010.

TECHNICAL FIELD

The present invention relates to a liquid crystal display device, and more specifically relates to a liquid crystal display device having a configuration where one pixel is divided into a plurality of sub-pixels in order to improve visual field angle characteristics.

BACKGROUND ART

As one of drive systems of a liquid crystal display device, there is conventionally known a system in which "one pixel is configured by a plurality of (typically, two) sub-pixels, and liquid crystal is driven such that the plurality of sub-pixels have different luminance from each other" (hereinafter referred to as a "pixel division system"). This pixel division system is a system to be adopted for improving visual field angle characteristics of the liquid crystal display device. It is to be noted that, hereinafter, a region forming one pixel (each of three-color pixels of R, G and B in the case of a liquid crystal display device where a color display is performed by using the three-color pixels of R, G and B) is referred to as a "pixel section", and a region forming a sub-pixel is referred to as a "sub-pixel section".

In the liquid crystal display device adopting the pixel division system, a potential (hereinafter referred to as a "charging potential") of a pixel electrode at the time of charging a pixel capacitance is made different in magnitude in each of the two sub-pixel sections. As a configuration for realizing this, there are known, for example, a configuration (hereinafter referred to as a "2G -1D configuration") where two gate bus lines GL1, GL2 and one source bus line SL are allocated with respect to one pixel section 9 as shown in FIG. 15; and a configuration (hereinafter referred to as a "1G-2D configuration") where one gate bus line GL and two source bus lines SL1, SL2 are allocated with respect to one pixel section 9 as shown in FIG. 16.

In a liquid crystal display device adopting the 2G -1D configuration (see FIG. 15), a difference in charging potential is obtained between the two sub-pixel sections by making a waveform of a scanning signal that is given to the gate bus line GL1, provided corresponding to one sub-pixel section, different from a waveform of a scanning signal that is given to the gate bus line GL2, provided corresponding to the other sub-pixel section. In this configuration, a gate driver for driving the gate bus line is typically realized by providing one or more IC chips on both sides (one end side and the other end side in a direction in which the gate bus line extends) of a display section. Further, a source driver for driving the source bus line is typically realized by providing one or more IC chips on one end side (one end side in a direction in which the source bus line extends) of the display section.

In a liquid crystal display device adopting the 1G -2D configuration (see FIG. 16), a difference in charging potential is obtained between the two sub-pixel sections by making a waveform of a video signal that is given to the source bus line SL1, provided corresponding to one sub-pixel section, different from a waveform of a video signal that is given to the source bus line SL2, provided corresponding to the other sub-pixel section. In this configuration, the gate driver is typically realized by providing one or more IC chips on one end side (one end side in a direction in which the gate bus line extends) of a display section, or monolithically forming them on a glass substrate on one end side of the display section. Further, a source driver is typically realized by providing one or more IC chips on both sides (one end side and the other end side in a direction in which the source bus line extends) of the display section.

It should be noted that configuration examples of the liquid crystal display device adopting the pixel division system are, for example, disclosed in Japanese Patent Application Laid-Open Nos. 2004-62146, 2008-145886, and 2007-86791, ""55.3: Driving Method of Integrated Gate Driver for Large Area LCD-TV" in SID 08 Digest" and the like.

PRIOR ART DOCUMENTS

Patent Documents

[Patent Document 1] Japanese Patent Application Laid-Open No. 2004-62146

[Patent Document 2] Japanese Patent Application Laid-Open No. 2008-145886

[Patent Document 3] Japanese Patent Application Laid-Open No. 2007-86791

Non-Patent Document

[Non-Patent Document 1] Min-Cheol Lee, Yong-Soon Lee, Seung-Hwan Moon, Dong-Gyu Kim, Kyung-Seob Kim, Nam Deog Kim, and Sang Soo Kim, "55.3: Driving Method of Integrated Gate Driver for Large Area LCD-TV", SID 08 Digest, p. 838-841, 2008.

SUMMARY OF THE INVENTION

Problems To Be Solved By The Invention

Incidentally, in the liquid crystal display device adopting the 2G-1D configuration, since the gate bus line GL1 provided corresponding to the one sub-pixel section and the gate bus line GL2 provided corresponding to the other sub-pixel section should be driven, twice as large a number of gate-driver IC chips are required as in a general liquid crystal display device (liquid crystal display device not adopting the pixel division system). Further, in the liquid crystal display device adopting the 1G-2D configuration, since the source bus line SL1 provided corresponding to the one sub-pixel section and the source bus line SL2 provided corresponding to the other sub-pixel section should be driven, twice as large a number of source-driver IC chips are required as in the general liquid crystal display device. As thus described, a large number of panel driving IC chips are required in the conventional liquid crystal display device adopting the pixel division system as compared with the general liquid crystal display device, thereby causing high cost.

Accordingly, it is an object of the present invention that in a liquid crystal display device having a configuration where one pixel is divided into a plurality of sub-pixels in order to improve visual field angle characteristics, the number of panel-driving IC chips is reduced as compared with a conventional one.

Means for Solving the Problems

A first aspect of the present invention is directed to a liquid crystal display device, comprising:

a display section;

a pixel section which contains a first sub-pixel section including a first switching element, a first pixel electrode connected to a first conduction terminal of the first switching element, and a first pixel capacitance that stores an electric charge in accordance with a potential of the first pixel electrode, and a second sub-pixel section including a second switching element, a second pixel electrode connected to a first conduction terminal of the second switching element, and a second pixel capacitance that stores an electric charge in accordance with a potential of the second pixel electrode, and forms an n-rows×m-columns pixel matrix (n and m are natural numbers) in the display section;

first scanning signal lines, provided corresponding to each row of the pixel matrix, and connected to a control terminal of the first switching element;

second scanning signal lines, provided corresponding to each row of the pixel matrix, and connected to a control terminal of the second switching element;

video signal lines, provided corresponding to each column of the pixel matrix, and connected to a second conduction terminal of the first switching element and a second conduction terminal of the second switching element;

a first scanning signal line drive circuit that drives the first scanning signal lines, a second scanning signal line drive circuit that drives the second scanning signal lines, and a video signal line drive circuit that drives the video signal lines, wherein the display section, the first scanning signal line drive circuit, and the second scanning signal line drive circuit are monolithically formed on one substrate, the first scanning signal line drive circuit has a first shift register configured by a plurality of stages which contain stages corresponding to each of the first scanning signal lines, the first shift register outputs scanning signals that are sequentially set to an on-level one by one from the plurality of stages based on a first clock signal group as two-phase clock signals whose phases are shifted by 180 degrees from each other, the second scanning signal line drive circuit has a second shift register configured by a plurality of scanning signal output stages and a plurality of dummy stages, the scanning signal output stages containing stages corresponding to each of the second scanning signal lines, the dummy stages being provided J by J (J is a natural number) between any two scanning signal output stages which are adjacent to each other, the second shift register outputs scanning signals that are sequentially set to the on-level one by one from the plurality of scanning signal output stages based on a second clock signal group as two-phase clock signals whose phases are shifted by 180 degrees from each other, and a frequency of the second clock signal group is made J+1 times as large as a frequency of the first clock signal group.

According to a second aspect of the present invention, in the first aspect of the present invention, the dummy stages are provided one by one between any two scanning signal output stages which are adjacent to each other.

According to a third aspect of the present invention, in the first aspect of the present invention, the first scanning signal line drive circuit is provided on one end side of the display section in a direction in which the first scanning signal lines and the second scanning signal lines extend, and the second scanning signal line drive circuit is provided on the other end side of the display section in the direction in which the first scanning signal lines and the second scanning signal lines extend.

According to a fourth aspect of the present invention, in the first aspect of the present invention, each stage constituting the first shift register and the second shift register includes an output node for outputting a scanning signal, an output control switching element having a second conduction terminal being connected to the output node, a first node connected to a control terminal of the output control switching element, a first node turn-on switching element having a second conduction terminal being connected to the first node, and a control terminal and a first conduction terminal to which an output signal from the output node of a preceding stage is given, and an output node turn-off switching element having a first conduction terminal being connected to the output node, a second conduction terminal to which an off-level potential is given, and a control terminal to which an output signal from the output node of a subsequent stage is given, either of the two-phase clock signals included in the first clock signal group is given to the first conduction terminal of the output control switching element in the first shift register, and either of the two-phase clock signals included in the second clock signal group is given to the first conduction terminal of the output control switching element in the second shift register.

Effects Of The Invention

According to the first aspect of the present invention, in the liquid crystal display device adopting the pixel division system, the display section and the scanning signal line drive circuit are monolithically formed on one substrate. Herein, the first scanning signal line drive circuit for driving the first scanning signal line provided corresponding to the first sub-pixel section is provided with the shift register (first shift register) configured by the plurality of stages which contain the stages corresponding to the respective first scanning signal lines, and the second scanning signal line drive circuit for driving the second scanning signal line provided corresponding to the second sub-pixel section is provided with the shift register (second shift register) configured by the stages (scanning signal output stages) corresponding to the respective second scanning signal lines and the dummy stages, provided by J (J is a natural number) each with respect to one scanning signal output stage. In such a configuration, a frequency of a clock signal for controlling an operation of the second shift register is made J+1 times as large as a frequency of a clock signal for controlling an operation of the first shift register. For this reason, on each row of the pixel matrix, a period of charging in the second sub-pixel section is 1/J as long as a period of charging in the first sub-pixel section. Thus, in the liquid crystal display device having a configuration where the scanning signal line drive circuit is monolithically formed, it is possible to make a charging potential in the first sub-pixel section different from a charging potential in the second sub-pixel section. From the above, it is possible to realize the liquid crystal display device adopting the pixel division system without providing scanning signal line driving IC chips therein. It is thus possible to reduce cost as to the liquid crystal display device adopting the pixel division system.

According to the second aspect of the present invention, the second shift register is provided with the dummy stages just in minimum required number. It is thus possible to more efficiently reduce cost as to the liquid crystal display device adopting the pixel division system.

According to the third aspect of the present invention, since the scanning signal line drive circuit is formed on both sides of the display section, it is possible to reduce cost as to the liquid crystal display device adopting the pixel division system, while efficiently using a picture-frame region.

According to the fourth aspect of the present invention, in each stage constituting the first shift register and the second shift register, the switching elements are provided just in minimum required number. It is thus possible to more efficiently reduce cost as to the liquid crystal display device adopting the pixel division system.

MODE FOR CARRYING OUT THE INVENTION

Hereinafter, an embodiment of the present invention will be described with reference to the accompanying drawings. It is to be noted that in the following description, a gate terminal (a gate electrode) of a thin-film transistor corresponds to the control terminal, a drain terminal (a drain electrode) thereof corresponds to the first conduction terminal, and a source terminal (a source electrode) thereof corresponds to the second conduction terminal. Further, a description will be given assuming that all the thin-film transistors are of an n-channel type.

<1. Whole Configuration and Operation>

Figure 2:
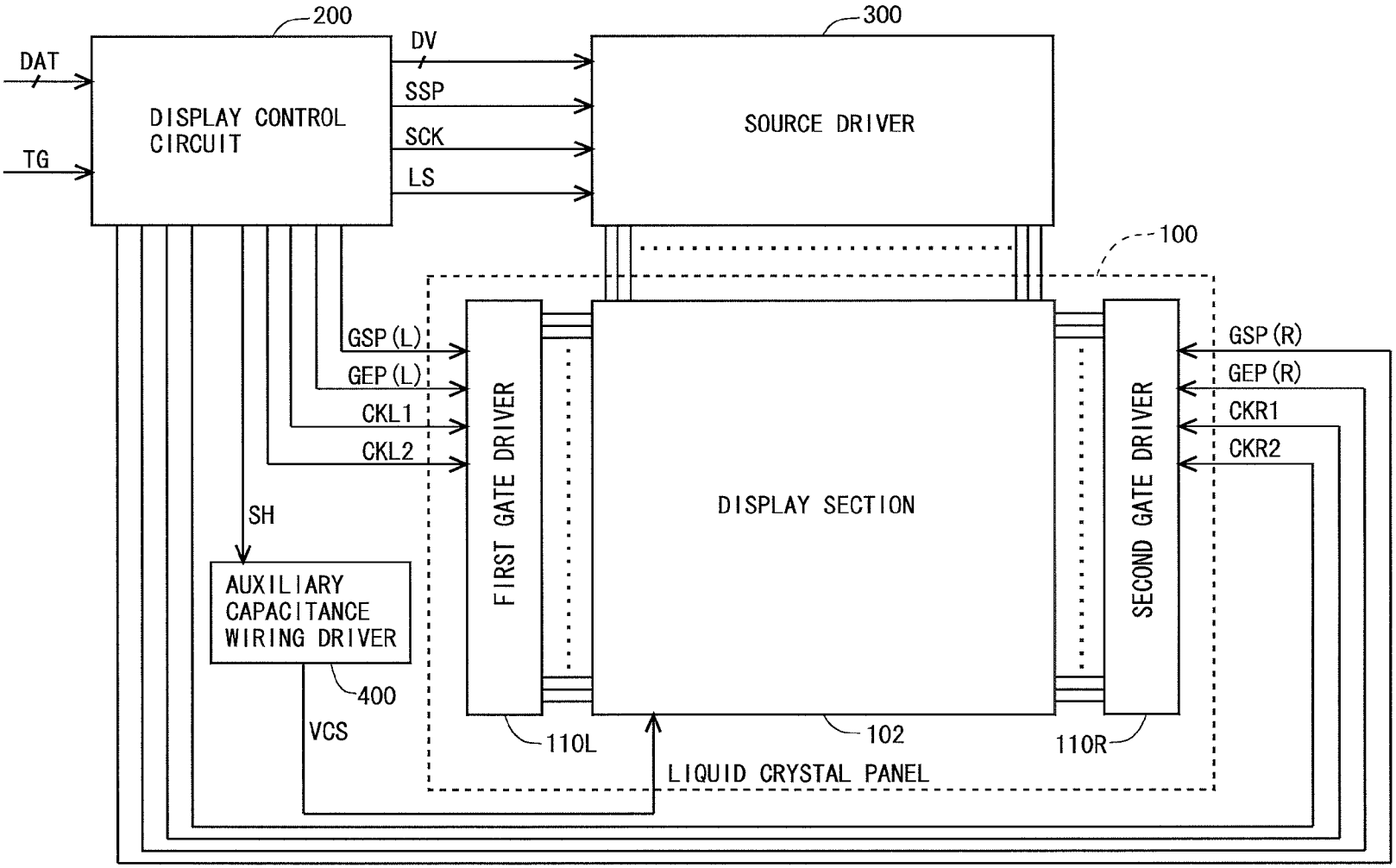
FIG. 2 is a block diagram showing a whole configuration of the liquid crystal display device in the above embodiment.

FIG. 2 is a block diagram showing a whole configuration of an active matrix-type liquid crystal display device in an embodiment of the present invention. As shown in FIG. 2, this liquid crystal display device is provided with a liquid crystal panel 100 including a display section 102 and gate drivers (a first gate driver 110L and a second gate driver 110R), a display control circuit 200, a source driver (video signal line drive circuit) 300, and an auxiliary capacitance wiring driver 400. The source driver 300 is mounted on a glass substrate in the form of IC chips. On the other hand, the gate driver, is monolithically formed on the glass substrate inside the liquid crystal panel 100.

Figure 3:
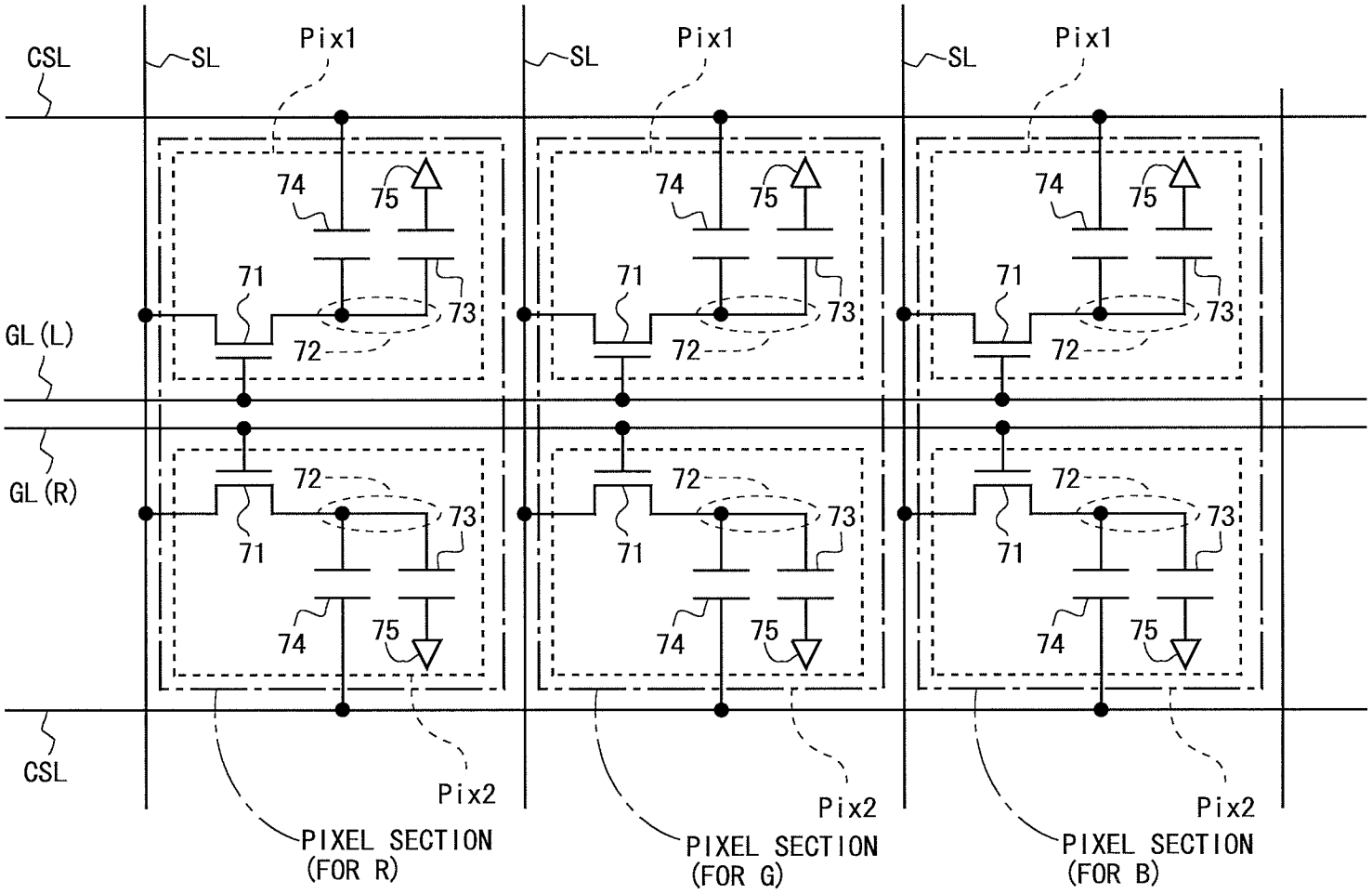
FIG. 3 is a circuit diagram showing a configuration of a pixel section inside the display section in the above embodiment.

The display section 102 is provided with a plurality of (m) source bus lines extending from the source driver 300, a plurality of (n) gate bus lines (hereinafter referred to as "first gate bus lines") extending from the first gate driver 110L, a plurality of (n) gate bus lines (hereinafter referred to as "second gate bus lines") extending from the second gate driver 110R, an auxiliary capacitance wiring extending from the auxiliary capacitance wiring driver 400, and a plurality of (n×m) pixel sections. An n-rows×m-columns pixel matrix is formed by the plurality of (n×m) pixel sections. It is to be noted that a color display is performed by using three pixels, which are a pixel for R (red) color, a pixel for G (green) color and a pixel for B (blue) color in a general display device, whereas in the present description, not the whole forming those three pixels but a region forming the pixel of each color is referred to as a "(one) pixel section", as described above. FIG. 3 is a circuit diagram showing a configuration of a pixel section inside the display section 102. As shown in FIG. 3, each of the pixel section for R (red) color, the pixel section for G (green) color, and the pixel section for B (blue) color is configured by two sub-pixel sections (a first sub-pixel section Pixl and a second sub-pixel section Pix2).

The sub-pixel section includes: a thin-film transistor (TFT) 71 where a gate electrode is connected to a gate bus line (a first gate bus line GL(L) in the case of the first sub-pixel section Pixl, and a second gate bus line GL(R) in the case of the second sub-pixel section Pix2) passing through a corresponding intersection, and a source electrode is connected to a source bus line SL passing through the intersection; a pixel electrode 72 connected to a drain electrode of the thin-film transistor 71; an opposite electrode (a common electrode) 75 and an auxiliary capacitance wiring (an auxiliary capacitance electrode) CSL which are provided in common in all of the sub-pixel sections inside the display section 102; a liquid crystal capacitance 73 formed by the pixel electrode 72 and the opposite electrode 75; and an auxiliary capacitance 74 formed by the pixel electrode 72 and the auxiliary capacitance wiring CSL. Further, a pixel capacitance is formed by the liquid crystal capacitance 73 and the auxiliary capacitance 74. Then, a voltage indicating a pixel value is held in the pixel capacitance based on a video signal that the source electrode of each thin-film transistor 71 receives from the source bus line SL when the gate electrode of the thin-film transistor 71 receives an active scanning signal from the gate bus line. It should be noted that in the present embodiment, a first switching element, a first pixel electrode, and a first pixel capacitance are realized respectively by the thin-film transistor 71, the pixel electrode 72, and the pixel capacitance inside the first sub-pixel section Pixl. Further, a second switching element, a second pixel electrode, and a second pixel capacitance are realized respectively by the thin-film transistor 71, the pixel electrode 72, and the pixel capacitance inside the second sub-pixel section Pix2.

Next, operations of the constituent elements shown in FIG. 2 will be described. The display control circuit 200 receives an image signal DAT and a timing signal group TG including a horizontal synchronization signal, a vertical synchronization signal, and the like, which are transmitted from the outside, and outputs a digital video signal DV; a source start pulse signal SSP, a source clock signal SCK, and a latch strobe signal LS, for controlling an operation of the source driver 300; a first gate start pulse signal GSP(L), a first gate end pulse signal GEP(L), a clock CKL1, and a clock CKL2, for controlling an operation of the first gate driver 110L; a second gate start pulse signal GSP(R), a second gate end pulse signal GEP(R), a clock CKR1, and a clock CKR2, for controlling an operation of the second gate driver 110R; and an auxiliary capacitance wiring control signal SH for controlling an operation of the auxiliary capacitance wiring driver 400. It is to be noted that in the present embodiment, a first clock signal group is realized by the clock CKL1 and the clock CKL2, and a second clock signal group is realized by the clock CKR1 and the clock CKR2.

The source driver 300 receives the digital video signal DV, the source start pulse signal SSP, the source clock signal SCK, and the latch strobe signal LS, which are outputted from the display control circuit 200, and applies a driving video signal to each source bus line. The first gate driver 110L repeats application of an active scanning signal to each first gate bus line in every one vertical scanning period as a cycle based on the first gate start pulse signal GSP(L), the first gate end pulse signal GEP(L), the clock CKL1, and the clock CKL2, which are outputted from the display control circuit 200. The second gate driver 110R repeats application of an active scanning signal to each second gate bus line in every one vertical scanning period as a cycle based on the second gate start pulse signal GSP(R), the second gate end pulse signal GEP(R), the clock CKR1, and the clock CKR2, which are outputted from the display control circuit 200. The auxiliary capacitance wiring driver 400 gives a predetermined potential VCS to the auxiliary capacitance wiring CSL based on the auxiliary capacitance wiring control signal SH outputted from the display control circuit 200.

As thus described, the driving video signal is applied to each source bus line and the scanning signal is applied to each first gate bus line and each second gate bus line, whereby an image based on the image signal DAT transmitted from the outside is displayed in the display section 102.

<2. Configuration of Inside of Liquid Crystal Panel>

Figure 1:
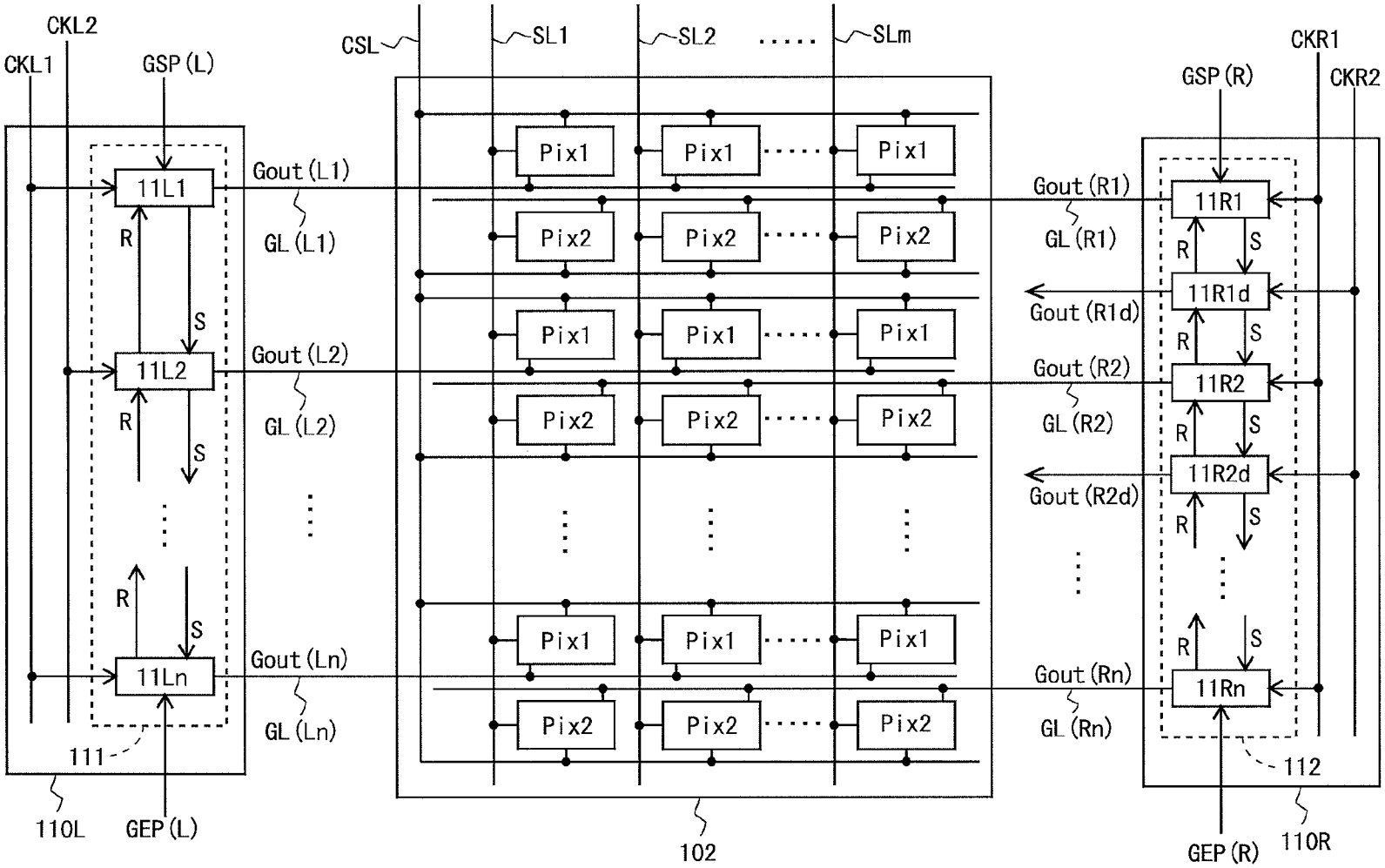
FIG. 1 is a block diagram showing a configuration of the inside of a liquid crystal panel in an active matrix-type liquid crystal display device according to an embodiment of the present invention.

FIG. 1 is a block diagram showing a configuration of the inside of the liquid crystal panel 100 according to the present embodiment. As shown in FIG. 1, in the liquid crystal panel 100, with the display section 102 at the center, the first gate driver 110L is provided on one end side (left side in FIG. 1) in a direction in which the gate bus lines extend, and the second gate driver 110R is provided on the other end side (right side in FIG. 1).

The first gate driver 110L has a shift register 111 which contains n stages. In the state of the n-rows×m-columns pixel matrix being formed in the display section 102 as described above, each stage of the shift register 111 is provided so as to correspond one by one to each row of the pixel matrix. Hereinafter, a circuit constituting each stage of the shift register is referred to as a stage constituent circuit. The shift register (hereinafter, also referred to as a "first shift register") 111 inside the first gate driver 110L includes n stage constituent circuits 11L1 to 11Ln. The n stage constituent circuits 11L1 to 11Ln are connected in series with one another. The stage constituent circuits 11L1 to 11Ln are respectively connected to first gate bus lines GL(L1) to GL(Rn).

On the other hand, the second gate driver 110R has a shift register 112 which contains (2*n*-1) stages. That is, the shift register (also referred to as a "second shift register") 112 inside the second gate driver 110R includes (2*n*-1) stage constituent circuits. The (2*n*-1) stage constituent circuits are connected in series with one another. In such a configuration, n stage constituent circuits 11R1 to 11Rn out of the (2*n*-1) stage constituent circuits are respectively connected to the second gate bus lines GL(R1) to GL(Rn), whereas stage constituent circuits 11Rid (i is an integer between 1 and n-1 inclusive) other than the n stage constituent circuits are not connected to the second gate bus line. As shown in FIG. 1, the stage constituent circuit 11Rid not connected to the second gate bus line is provided between any two stage constituent circuits which are adjacent to each other when attention is focused on the stage constituent circuits connected to the second gate bus line. These stage constituent circuits 11Rid are provided to synchronize an operation of the first shift register 111 and an operation of the second shift register 112, and function as so-called dummy circuits. Hereinafter, these stage constituent circuits 11Rid are referred to as "dummy output stage constituent circuits". It is to be noted that in the present embodiment, the scanning signal output stages are realized by the stage constituent circuits 11R1 to 11Rn, and the dummy stages are realized by the dummy output stage constituent circuits 11Rid. Further, although the dummy output stage constituent circuit is not provided in the subsequent stage of the stage constituent circuit 11Rn in a final stage in the present embodiment, the configuration may be such that the dummy output stage constituent circuit is provided in the subsequent stage of the stage constituent circuit 11Rn in the final stage.

Inside the display section 102, the first sub-pixel section Pixl is connected to the first gate bus line, and the second sub-pixel section Pix2 is connected to the second gate bus line. More specifically, the gate electrode of the thin-film transistor 71 inside the first sub-pixel section Pixl is connected to the first gate bus line, and the gate electrode of the thin-film transistor 71 inside the second sub-pixel section Pix2 is connected to the second gate bus line (see FIG. 3). The scanning signals Gout(L1) to Gout (Ln) are respectively applied from the stage constituent circuits 11L1 to 11Ln inside the first shift register 111 to the first gate bus lines GL(L1) to GL(Ln), and the scanning signals Gout(R1) to Gout (Rn) are respectively applied from the stage constituent circuits 11R1 to 11Rn inside the second shift register 112 to the second gate bus lines GL(R1) to GL(Rn).

Figure 4:
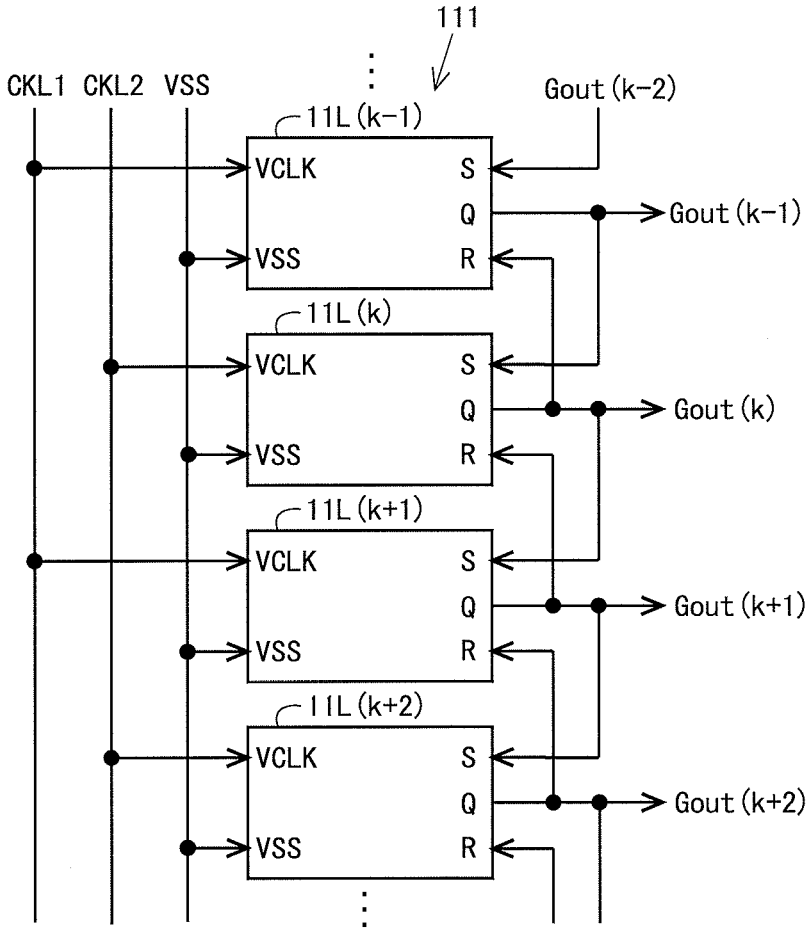
FIG. 4 is a block diagram showing a configuration of a first shift register in the above embodiment.

Next, a detailed configuration of the shift register in the present embodiment will be described with reference to FIGS. 4 and 5. FIG. 4 is a block diagram showing a detailed configuration of stage constituent circuits 11L(k-1) to 11L(k+

2) which constitute a (k-1)th stage to a (k+2)th stage in the first shift register 111. It is to be noted that k is an even number between 2 and (n-2) inclusive. Each stage (each stage constituent circuit) of the first shift register 111 is provided with an input terminal for receiving a clock VCLK, an input terminal for receiving a low-level DC power supply potential VSS, an input terminal for receiving a set signal S, an input terminal for receiving a reset signal R, and an output terminal for outputting an output signal Q.

Signals to be given to the input terminals in each stage (each stage constituent circuit) of the first shift register 111 are as follows. The clock CKL1 is given as the clock VCLK in an odd stage, and the clock CKL2 is given as the clock VCLK in an even stage. Further, in any stage, the output signal Q from the preceding stage is given as the set signal S, and the output signal Q from the subsequent stage is given as the reset signal R. However, in a first stage, the first gate start pulse signal GSP(L) is given as the set signal S, and in an nth stage (final stage), the first gate end pulse signal GEP(L) is given as the reset signal R. It should be noted that the low-level DC power supply potential VSS is given in common to all of the stage constituent circuits. The output signal Q is outputted from each stage (each stage constituent circuit) of the first shift register 111. The output signal Q from each stage is given as the scanning signal Gout to the corresponding first gate bus line, while being given as the reset signal R to the preceding stage and given as the set signal S to the subsequent stage.

In the configuration as above, when a pulse of the first gate start pulse signal GSP(L) is given as the set signal S to the first stage of the first shift register 111, a shift pulse included in the output signal Q from each stage is transmitted sequentially from the first stage to the nth stage based on the clock CKL1 and the clock CKL2. Then, the scanning signal Gout outputted from each stage sequentially becomes active in accordance with this transfer of the shift pulse.

It is to be noted that the second shift register 112 also has a similar configuration to that of the first shift register 111. However, although the output signal Q from the dummy output stage constituent circuit is given as the reset signal R to the preceding stage and given as the set signal S to the subsequent stage, it is not given to the second gate bus line inside the display section 102. Further the clock CKR1 or the clock CKR2 is given as the clock VCLK to each stage. Moreover, in the first stage, the second gate start pulse signal GSP(R) is given as the set signal S, and in the final stage, the second gate end pulse signal GEP(R) is given as the reset signal R.

Figure 5:
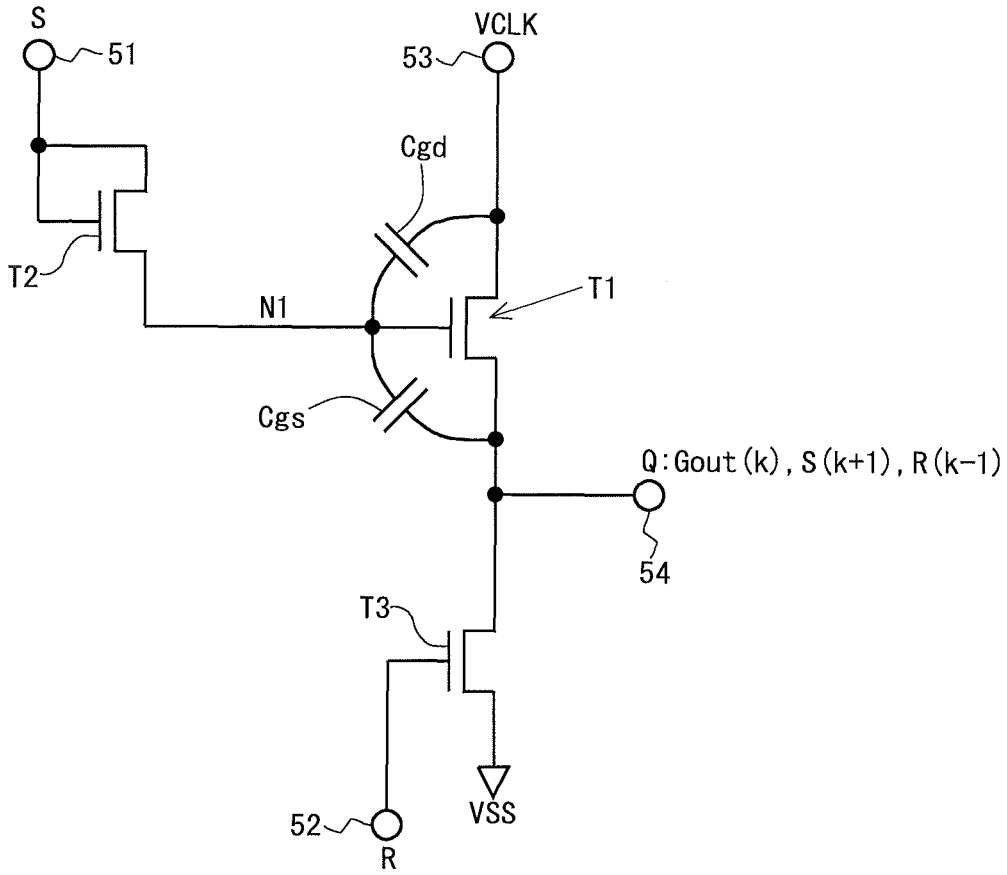
FIG. 5 is a circuit diagram showing a configuration of a stage constituent circuit (a configuration of one stage of a shift register) in the above embodiment.

FIG. 5 is a circuit diagram showing a configuration of the stage constituent circuit (a configuration of one stage of the shift register). As shown in FIG. 5, the stage constituent circuit is provided with three thin-film transistors T1, T2 and T3. Further, this stage constituent circuit has three input terminals 51 to 53 and one output terminal (output node) 54 besides an input terminal for the low-level DC power supply potential VSS. Herein, reference character 51 is provided to the input terminal that receives the set signal S, reference character 52 is provided to the input terminal that receives the clock VCLK, and reference character 53 is provided to the input terminal that receives the reset signal R. A parasitic capacitance Cgd is formed between a gate terminal and a drain terminal of the thin-film transistor T1, and a parasitic capacitance Cgs is formed between the gate terminal and a source terminal of the thin-film transistor T1. The gate terminal of the thin-film transistor T1 and a source terminal of the thin-film transistor T2 are connected to each other. It is to be noted that a region (wiring) where these are connected to each other is hereinafter referred to as a "first node" and is provided with reference character N1.

As for the thin-film transistor T1, the gate terminal is connected to the first node N1, the drain terminal is connected to the input terminal 53, and the source terminal is connected to the output terminal 54. As for the thin-film transistor T2, a gate terminal and a drain terminal are connected to the input terminal 51 (i.e., those are diode-connected), and the source terminal is connected to the first node N1. As for the thin-film transistor T3, a gate terminal is connected to the input terminal 52, a drain terminal is connected to the output terminal 54, and a source terminal is provided with the DC power supply potential VSS.

Next, a function of each constituent element in this stage constituent circuit will be described. The thin-film transistor T1 gives a potential of the clock VCLK to the output terminal 54 when a potential of the first node N1 is on a high-level. The thin-film transistor T2 changes the potential of the first node N1 toward the high level when the set signal S is on the high level. The thin-film transistor T3 changes a potential of the output terminal 54 toward the DC power supply potential VSS when the reset signal R is on the high level.

It is to be noted that in the present embodiment, an output control switching element is realized by the thin-film transistor T1, a first node turn-on switching element is realized by the thin-film transistor T2, and an output node turn-off switching element is realized by the thin-film transistor T3.

<3. Operation>

<3.1 Operation of Stage Constituent Circuit>

Figure 6:
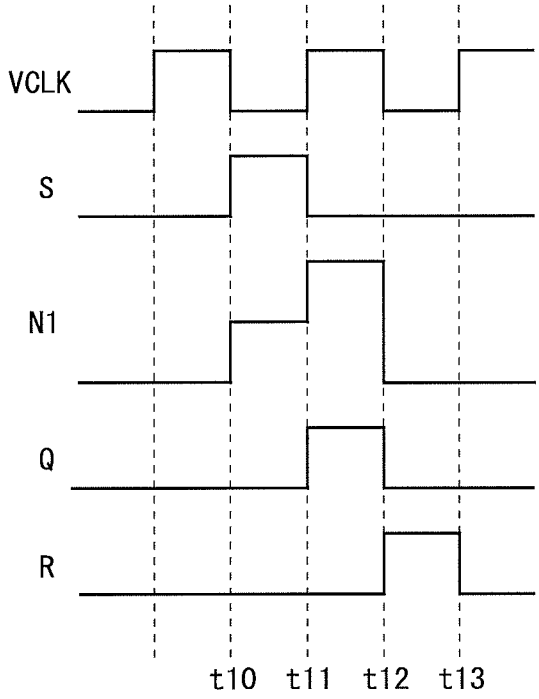
FIG. 6 is a signal waveform diagram for explaining an operation of the stage constituent circuit in the above embodiment.

An operation of the stage constituent circuit in the present embodiment will be described with reference to FIGS. 5 and 6. As shown in FIG. 6, in a period before a time point t10, the potential of the first node N1 and the potential of the output signal Q (the output terminal 54) are on the low level. Further, the input terminal 53 is provided with the clock VCLK which shifts to the high level in every predetermined period. It is to be noted that, concerning FIG. 6, ideal waveforms are shown here although a certain delay may occur in actual waveforms.

At the time point t10, a pulse of the set signal S is given to the input terminal 51. Since the thin-film transistor T2 is diode-connected as shown in FIG. 5, the thin-film transistor T2 comes into an on-state by this pulse of the set signal S. Thereby, the potential of the first node N1 changes from the low level to the high level, and the thin-film transistor T1 comes into the on-state. Herein, during a period from t10 to t11, the clock VCLK is on the low level. For this reason, during this period, the output signal Q is held on the low level.

At a time point t11, the clock VCLK changes from the low level to the high level. At this time, since the thin-film transistor T1 is on the on-state, the potential of the output terminal 54 increases with an increase in potential of the input terminal 53. Herein, as described above, the parasitic capacitance Cgd is formed between the gate terminal and the drain terminal of the thin-film transistor T1, and the parasitic capacitance Cgs is formed between the gate terminal and the source terminal of the thin-film transistor T1. For this reason, the potential of the first node N1 significantly increases due to a bootstrap effect. As a result, a large voltage is applied to the thin-film transistor T1, and the potential of the output signal Q increases to the high level potential of the clock VCLK. This brings the gate bus line connected to the output terminal 54 of this stage constituent circuit into a selected state. It is to be noted that during a period from t11 to t12, the reset signal R is on the low level. For this reason, the thin-film transistor T3 is held in an off-state, thus preventing the potential of the output signal Q from decreasing during this period.

At a time point t12, the clock VCLK changes from the high level to the low level. Thereby, the potential of the output terminal 54 decreases with a decrease in potential of the input terminal 53, and further, the potential of the first node N1 also decreases via the parasitic capacitances Cgd, Cgs. Moreover, at the time point t12, a pulse of the reset signal R is given to the input terminal 52. This brings the thin-film transistor T3 into the on-state. As a result, the potential of the output terminal 54, namely the potential of the output signal Q, decreases to the low level.

<3.2 Operation of Gate Driver>

Figure 7:
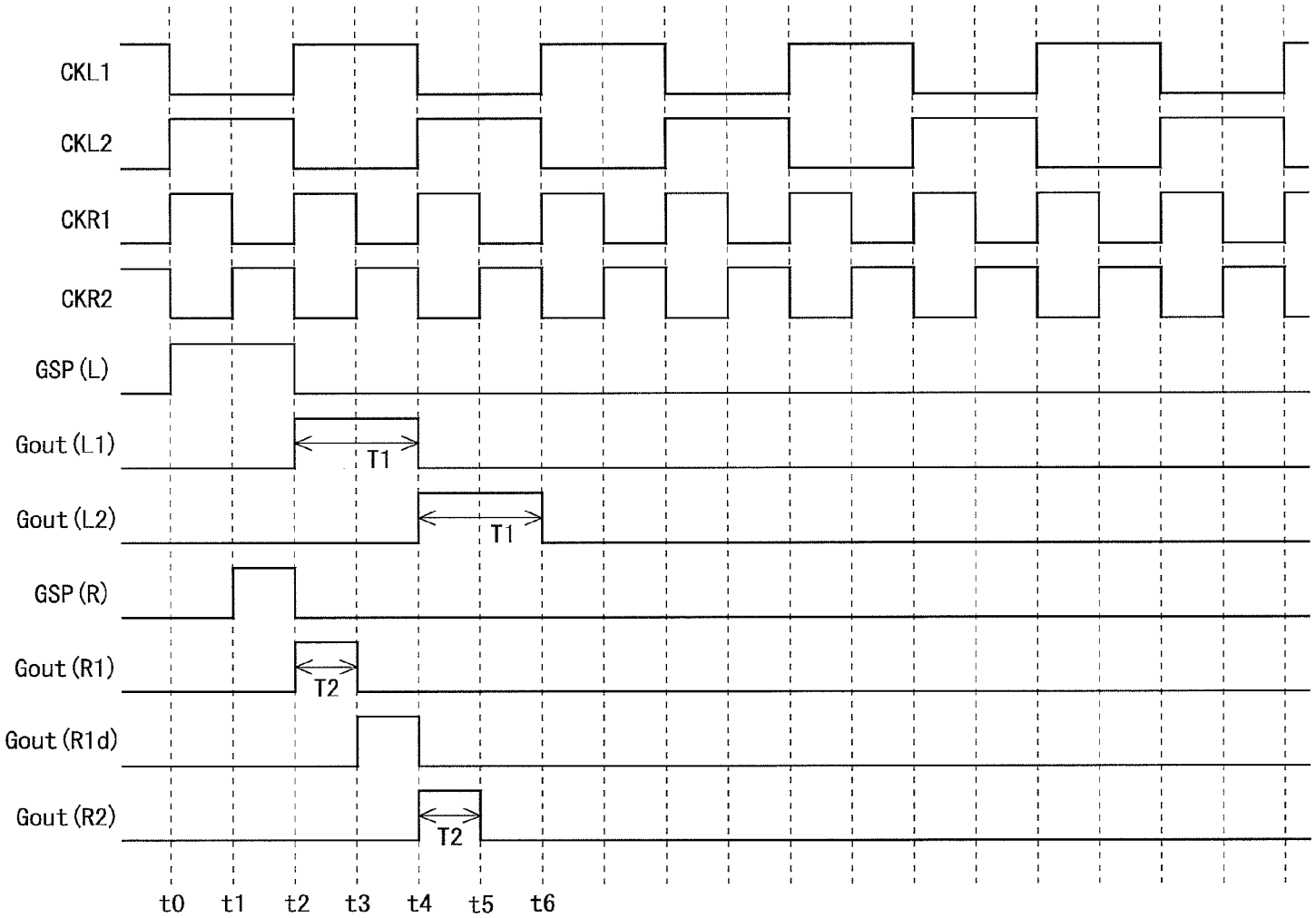
FIG. 7 is a signal waveform diagram for explaining an operation of a gate driver in the above embodiment.

Next, considering the foregoing operation as to the stage constituent circuit, operations of the gate drivers (the first gate driver 110L and the second gate driver 110R) will be described with reference to FIG. 7. Through an operating period of this liquid crystal display device, the clock CKL1 and the clock CKL2, as two-phase clock signals whose phases are shifted by 180 degrees from each other, are given to the first gate driver 110L, and the clock CKR1 and the clock CKR2, as two-phase clock signals whose phases are shifted by 180 degrees from each other, are given to the second gate driver 110R. The frequencies of the clocks CKR1, CKR2 are twice as large as the frequencies of the clocks CKL1, CKL2, as shown in FIG. 7.

At a time point t0, the pulse of the first gate start pulse signal GSP(L) is given to the first gate driver 110L. This pulse is inputted into a stage constituent circuit 11L1 in the first stage of the first shift register 111. It should be noted that in a period from time point t0 to time point t2, the clock CKL1 that is given to the stage constituent circuit 11L1 as the clock VCLK is held on the low level, and hence the scanning signal Gout (L1) is held on the low level.

At a time point t1, a pulse of the second gate start pulse signal GSP(R) is given to the second gate driver 110R. This pulse is inputted into the stage constituent circuit 11R1 in the first stage of the second shift register 112. It should be noted that in a period from the time point t1 to time point t2, the clock CKR1 that is given to the stage constituent circuit 11R1 as the clock VCLK is held on the low level, and hence the scanning signal Gout (R1) is held on the low level.

At a time point t2, the clock CKL1 changes from the low level to the high level. Thereby, the output signal Q from the stage constituent circuit 11L1, namely the scanning signal Gout (L1), changes from the low level to the high level. Further, at the time point t2, the clock CKR1 changes from the low level to the high level. Thereby, the output signal Q from the stage constituent circuit 11R1, namely the scanning signal Gout (R1), changes from the low level to the high level.

At a time point t3, the clock CKR2 changes from the low level to the high level, and the output signal Gout(R1*d*) from a dummy output stage constituent circuit 11R1*d* in a subsequent stage of the stage constituent circuit 11R1 changes from the low level to the high level. The output signal Gout (R1*d*) is given as the reset signal R to the stage constituent circuit 11R1. Thereby, at the time point t3, the scanning signal Gout(R1) changes from the high level to the low level.

At a time point t4, the clock CKL2 changes from the low level to the high level, and the output signal Q from the stage constituent circuit 11L2, namely a scanning signal Gout (L2), changes from the low level to the high level. The scanning signal Gout (L2) is given as the reset signal R to the stage constituent circuit 11L1. Thereby, the scanning signal Gout (L1) changes from the high level to the low level. Further, at the time point t4, the clock CKR1 changes from the low level to the high level. Thereby, the output signal Q from the stage constituent circuit 11R2, namely a scanning signal Gout (R2), changes from the low level to the high level. The scanning signal Gout (R2) is given as the reset signal R to the dummy output stage constituent circuit 11R1*d*. Thereby, the output signal Gout(R1*d*) from the dummy output stage constituent circuit 11R1*d* changes from the high level to the low level.

By repetition of such operations as above, the scanning signals Gout(L1) to Gout (Ln), which shift to the high level sequentially in each period of length denoted by reference character T1 (hereinafter also referred to simply as a "period T1") in FIG. 7, are sequentially given row by row to the first gate bus lines GL(L1) to GL(Ln). Further, the scanning signals Gout(R1) to Gout (Rn), which shift to the high level sequentially in each period of length denoted by reference character T2 (hereinafter also referred to simply as a "period T2") in FIG. 7, are sequentially given row by row to the second gate bus lines GL(R1) to GL(Rn). Thereby, in the first sub-pixel section Pixl connected to the first gate bus lines GL(L1) to GL(Ln), a pixel capacitance is charged during a period of length denoted by reference character T1. Meanwhile, in the second sub-pixel sections Pix2 connected to the second gate bus lines GL(R1) to GL(Rn), a pixel capacitance is charged during a period of length denoted by reference character T2.

<4. Charging in Sub-Pixel Sections>

Next, a description will be given as to how pixel capacitances are charged in the first sub-pixel section Pixl and the second sub-pixel section Pix2 by the gate driver operating in such a manner as above described. In the present embodiment, the frequencies of the clocks CKR1, CKR2 are twice as large as the frequencies of the clocks CKL1, CKL2 (see FIG. 7). Therefore, concerning FIG. 7, the next equation (1) holds as to the relation between the length of the period T1 and the length of the period T2.

$$T2=(1/2)\times T1 \quad (1)$$

Figure 8:
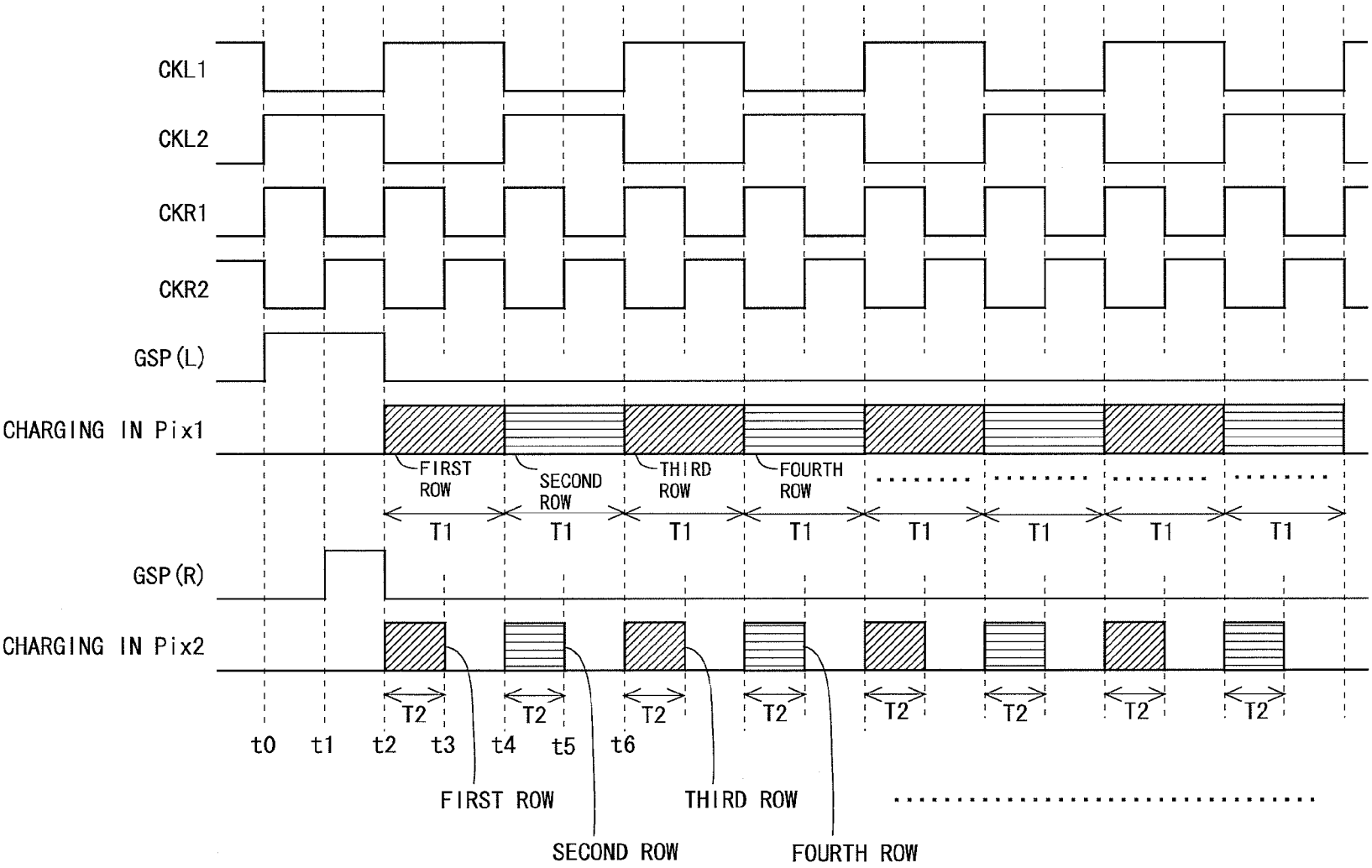
FIG. 8 is a diagram for explaining charging in sub-pixel sections in the above embodiment.

For this reason, on each row, the period of charging in the second sub-pixel section Pix2 is a half as long as the period of charging in the first sub-pixel section Pix1. It should be noted that FIG. 8 schematically shows the periods of charging in the first sub-pixel section Pixl and the second sub-pixel section Pix2.

Figures 9, 10:
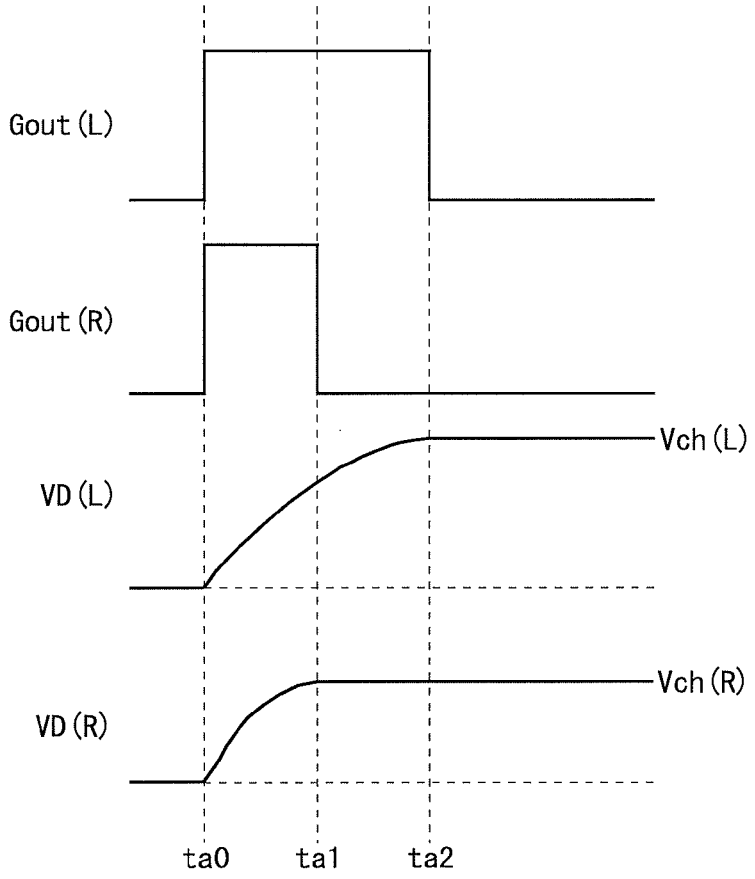
FIG. 9 is a signal waveform diagram for explaining charging in the sub-pixel sections in the above embodiment.
FIG. 10 is a diagram for explaining an effect of reduction in IC chips in the above embodiment.

Incidentally, as shown in FIG. 9, when the scanning signal Gout(L) that is applied to the first gate bus line rises for example at a time point ta0, the gate voltage of the thin-film transistor 71 is set to the on-level and the drain potential (the potential of the pixel electrode 72) VD(L) of the thin-film transistor 71 gradually increases from the time point ta0 in the first sub-pixel section Pix1 (see FIG. 3) connected to the first gate bus line. The scanning signal Gout(L) falls at a time point ta2. The drain potential VD(L) rises to Vch(L) at the time point ta2. This potential Vch(L) becomes a charging potential in the first sub-pixel section Pix1. Further, at the time point ta0, the scanning signal Gout(R) that is applied to the second gate bus line also rises. Thereby, the gate voltage of the thin-film transistor 71 is set to the on-level and the drain potential VD (R) of the thin-film transistor 71 gradually increases from the time point ta0 in the second sub-pixel section Pix2 connected to the second gate bus line. The scanning signal Gout(R) falls at a time point ta1. The drain potential VD(R) rises to Vch(R) at the time point ta1. This potential Vch(R) becomes a charging potential in the second sub-pixel section Pix2. Herein, with the above equation (1) holding, the next equation (2) holds as to the relation between the charging potential Vch(L) in the first sub-pixel section Pix1 and the charging potential Vch(R) in the second sub-pixel section Pix2.

$$Vch(L)=Z\times Vch(R) \quad (2)$$

Herein, Z is a parameter that depends on a length of a gate-on period of the thin-film transistor 71 in the first sub-pixel section Pix1 and the second sub-pixel section Pix2.

With Q=C×V (Q is a charge amount, C is a capacitance value, and V is a voltage between both ends of the capacitor) generally holding, when a charge amount to be charged is Qd, a drain potential (a charging potential) is Vd, and a drain capacitance is Cd, the next equation (3) holds. In this regard, it is assumed that potentials of the opposite electrode (the common electrode) 75 and the auxiliary capacitance wiring (the auxiliary capacitance electrode) CSL are 0.

$$Vd=Qd/Cd \tag{3}$$

Further, concerning the first sub-pixel section Pix1, when a charge amount to be charged is Qd(L) and a drain capacitance is Cd(L), a charge potential Vch(L) is expressed by the next equation (4), on the basis of the above equation (3).

$$Vch(L)=Qd(L)/Cd(L) \tag{4}$$

Moreover, concerning the second sub-pixel section Pix2, when a charge amount to be charged is Qd(R) and a drain capacitance is Cd(R), a charging potential Vch(R) is expressed by the next equation (5), on the basis of the above equation (3).

$$Vch(R)=Qd(R)/Cd(R) \tag{5}$$

The charge amount Qd to be charged can be controlled by a charge amount Qtft which the thin-film transistor 71 can allow flowing in unit time, namely a magnitude of a current Id, and by a length of the gate-on period of the thin-film transistor 71. Therefore, concerning the above equations (4) and (5), even when Cd(L) and Cd(R) are made equal and a same source potential (potential of a video signal) is given to the first sub-pixel section Pixl and the second sub-pixel section Pix2, magnitudes of Vch(L) and Vch(R) can be made different by making the length of the gate-on period of the thin-film transistor 71 different between the first sub-pixel section Pix1 and the second sub-pixel section Pix2.

<5. Effects>

According to the present embodiment, in the liquid crystal display device adopting the pixel division system in accordance with the 2G-1D configuration, the gate driver is monolithically formed on the glass substrate. Herein, the first gate driver 110L for driving the first gate bus line provided corresponding to one sub-pixel section (first sub-pixel section Pix1) is provided with the shift register (first shift register 111) having a configuration where the stage constituent circuits corresponding to the respective first gate bus lines are connected in series with one another, and the second gate driver 110R for driving the second gate bus line provided corresponding to the other sub-pixel section (second sub-pixel section Pix2) is provided with the shift register (second shift register 112) having a configuration where the stage constituent circuits, corresponding to the respective second gate bus lines, and the dummy output stage constituent circuits, each disposed for each stage constituent circuit, are connected in series with one another. In such a configuration, frequencies of the clocks CKR1, CKR2 for controlling the operation of the second shift register 112 are made twice as large as frequencies of the clocks CKL1, CKL2 for controlling the operation of the first shift register 111. For this reason, on each row, charging of the pixel capacitances in the first sub-pixel section Pix1 and the second sub-pixel section Pix2 are started at the same timing, and the period of charging in the second sub-pixel section Pix2 is a half as long as the period of charging in the first sub-pixel section Pix1. Thus, in the liquid crystal display device having the configuration where the gate driver is monolithically formed, it is possible to make the charging potential in the first sub-pixel section Pix1 different from the charging potential in the second sub-pixel section Pix2. From the above, it is possible to realize the liquid crystal display device adopting the pixel division system without providing the gate-driver IC chips therein.

Effects of reduction in IC chips in the present embodiment will be described with reference to FIG. 10. It should be noted that in FIG. 10, p indicates the number of gate-driver IC chips provided in a general liquid crystal display device (a liquid crystal display device not adopting the pixel division system), and q indicates the number of source-driver IC chips provided in the general liquid crystal display device. In the conventional liquid crystal display device having the 2G-1D configuration, 2p gate-driver IC chips have been provided for driving the gate bus lines in number twice as large as in the general liquid crystal display device. In the conventional liquid crystal display device having the 1G-2D configuration, 2q source-driver IC chips have been provided for driving the source bus lines in number twice as large as in the general liquid crystal display device. On the other hand, in the present embodiment, the gate-driver IC chips are not provided since the gate drivers have been monolithically formed. Further, as compared with the conventional liquid crystal display device having the 1G-2D configuration, the number of source-driver IC chips is a half as large. In such a manner, as compared with the conventional liquid crystal display device adopting the pixel division system, the number of panel driving IC chips can be reduced. It is thus possible to reduce cost as to the liquid crystal display device adopting the pixel division system.

<6. Modified Examples>

Hereinafter, the modified examples of the above embodiment will be described.

<6.1 First Modified Example>

Concerning the second shift register, in the above embodiment, just one dummy output stage constituent circuit has been provided for each row of the pixel matrix. However, the present invention is not limited to this, and the configuration may be such that a plurality of dummy output stage constituent circuits are provided for each row of the pixel matrix. So, a modified example as to the configuration of the second shift register will hereinafter be described as a first modified example.

Figure 11:
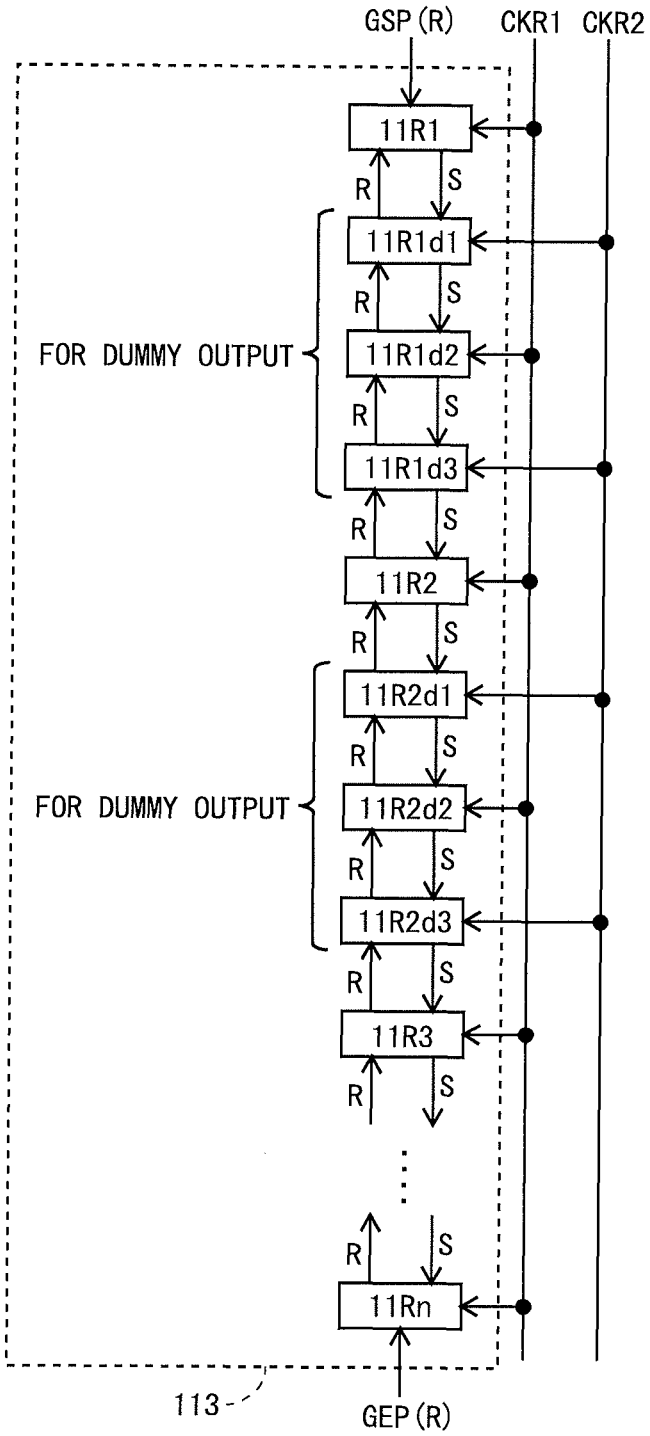
FIG. 11 is a block diagram showing a configuration of a second shift register in a first modified example of the above embodiment.

FIG. 11 is a block diagram showing a configuration of a second shift register 113 in the first modified example of the above embodiment. In the present modified example, as shown in FIG. 11, three dummy output stage constituent circuits are provided for each row of the pixel matrix (but a final row is an exception). It is to be noted that the first shift register 111 has a similar configuration to the above embodiment.

Figure 12:
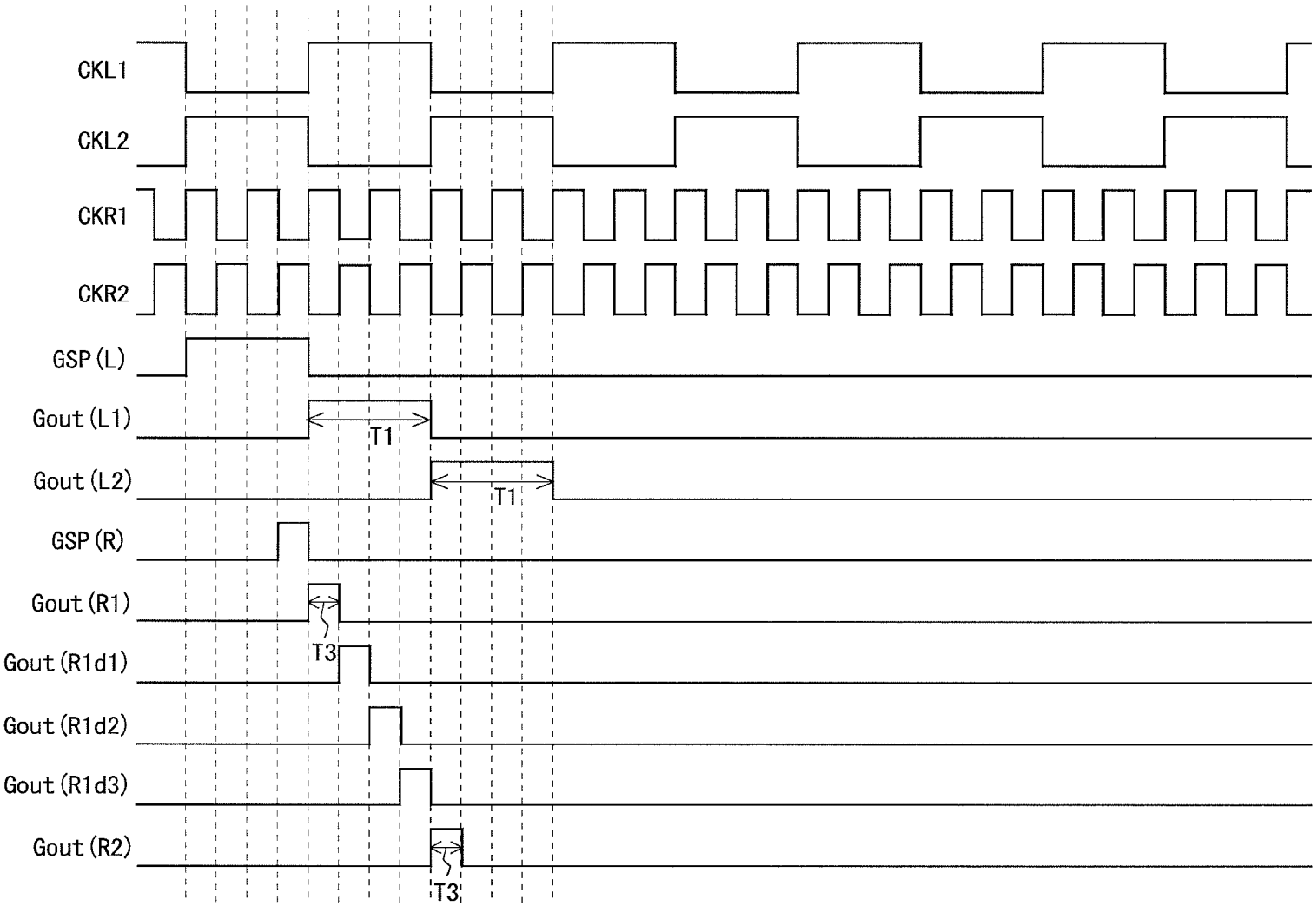
FIG. 12 is a signal waveform diagram for explaining an operation of a gate driver in the first modified example of the above embodiment.
Figure 13:
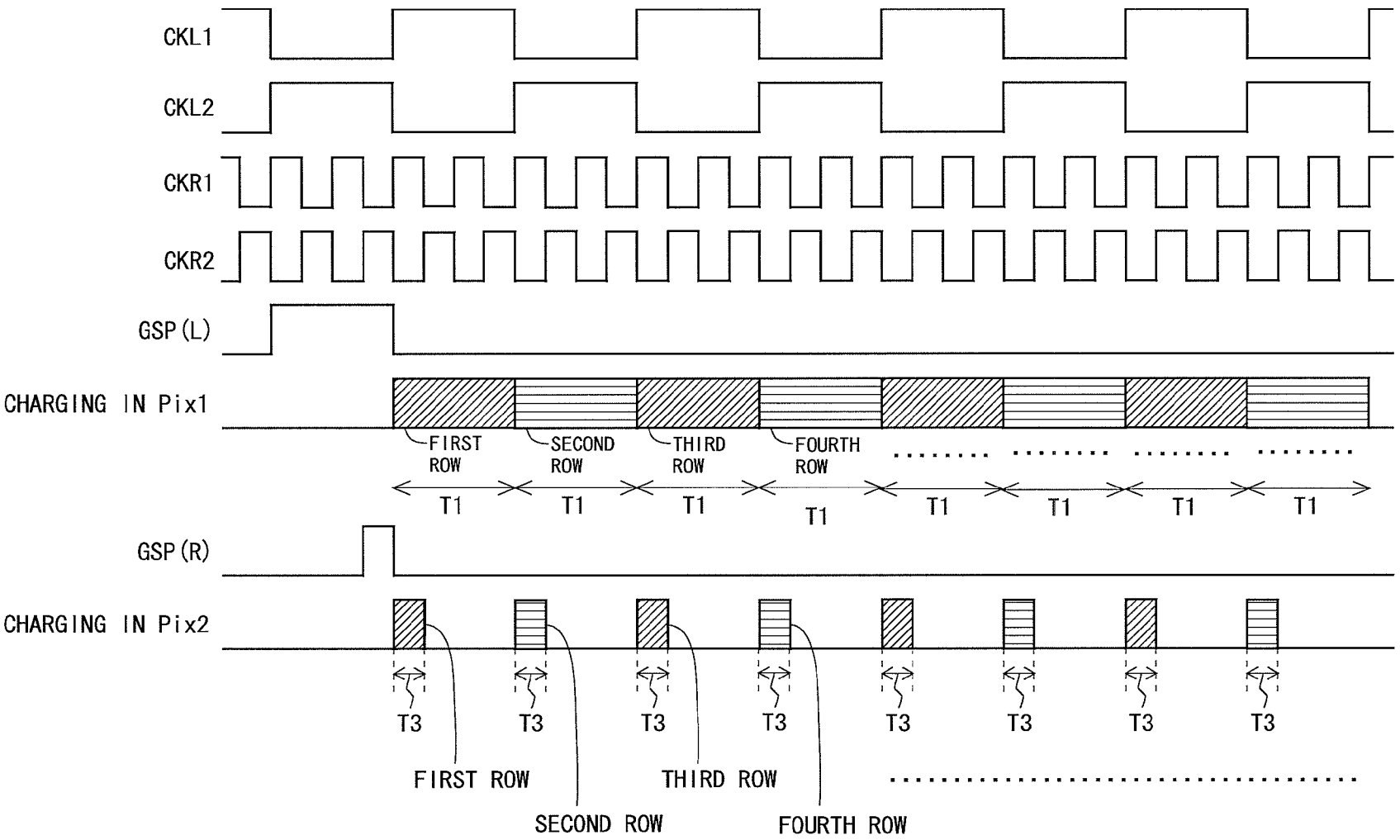
FIG. 13 is a diagram for explaining charging in sub-pixel sections in the first modified example of the above embodiment.

In such a configuration as above, as shown in FIG. 12, frequencies of the clocks CKR1, CKR2 for controlling the operation of the second shift register 113 are made four times as large as frequencies of the clocks CKL1, CKL2 for controlling the operation of the first shift register 111. Thereby, in the present modified example, as shown in FIG. 12, a period T3 in which a scanning signal that is applied to the second gate bus line is held on the high level is a quarter as long as a period T1 in which a scanning signal that is applied to the first gate bus line is held on the high level. As a result, on each row, the period of charging in the second sub-pixel section Pix2 is a quarter as long as the period of charging in the first sub-pixel section Pix1. It should be noted that FIG. 13 schematically shows the periods of charging in the first sub-pixel section Pixl and the second sub-pixel section Pix2.

As thus described, also in the present modified example, in the liquid crystal display device having the configuration where the gate driver is monolithically formed, it is possible to make the charging potential in the first sub-pixel section Pixl different from the charging potential in the second sub-pixel section Pix2. It is thereby possible to realize the liquid crystal display device adopting the pixel division system without providing gate-driver IC chips therein.

It is to be noted that in the case of forming a configuration where J dummy output stage constituent circuits are provided for each row of the pixel matrix, frequencies of the clocks CKR1, CKR2 for controlling the operation of the second shift register are to be made (J+1) times as large as frequencies of the clocks CKL1, CKL2 for controlling the operation of the first shift register. For example, such a configuration is adopted that two dummy output stage constituent circuits are provided for each row of the pixel matrix, and frequencies of the clocks CKR1, CKR2 can be made three times as large as frequencies of the clocks CKL1, CKL2.

<6.2 Second Modified Example>

In the above embodiment, the description has been given taking as the example the stage constituent circuit having the configuration shown in FIG. 5, but the configuration of the stage constituent circuit is not particularly limited. So, a modified example as to the configuration of the stage constituent circuit will hereinafter be described as a second modified example.

Figure 14:
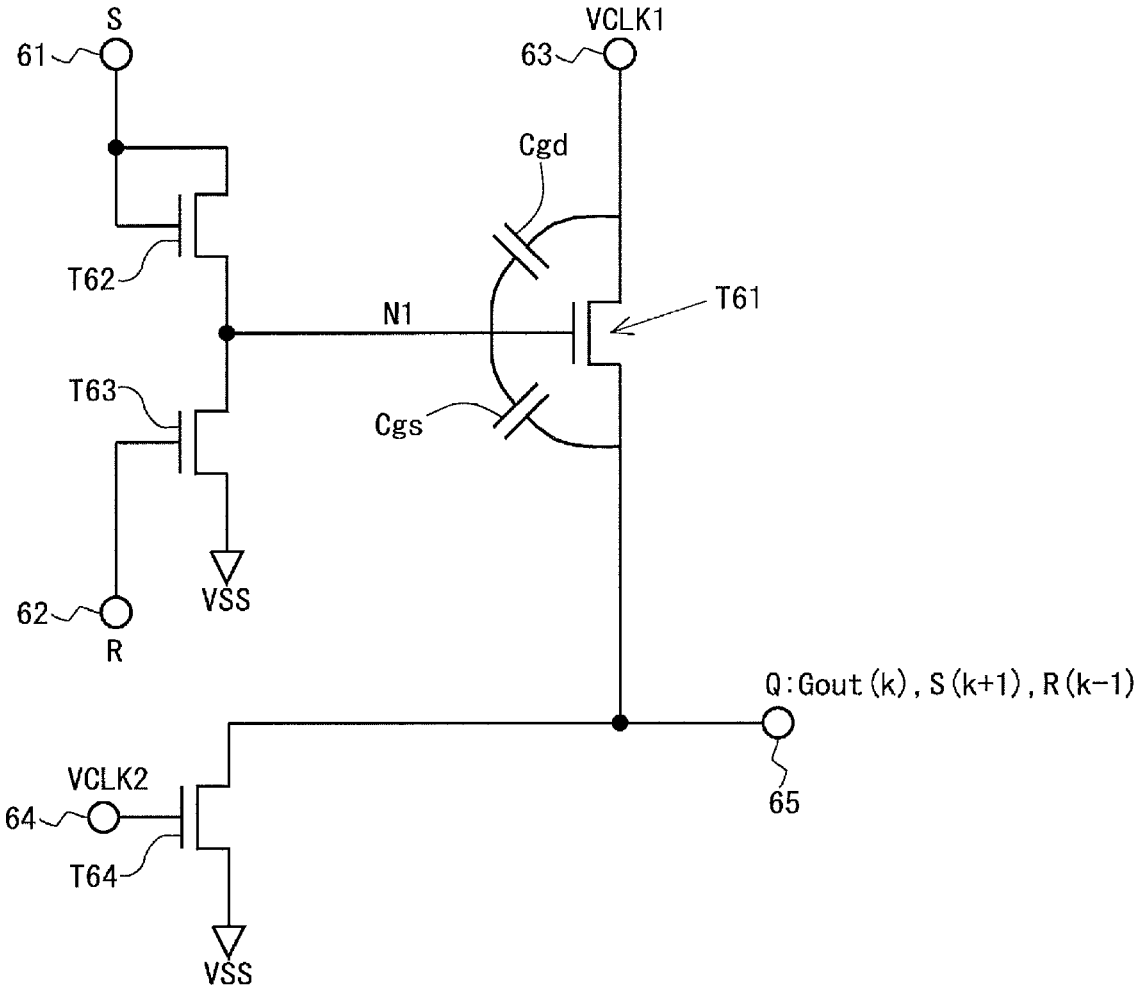
FIG. 14 is a circuit diagram showing a configuration of a stage constituent circuit (a configuration of one stage of a shift register) in a second modified example of the above embodiment.
Figure 15:
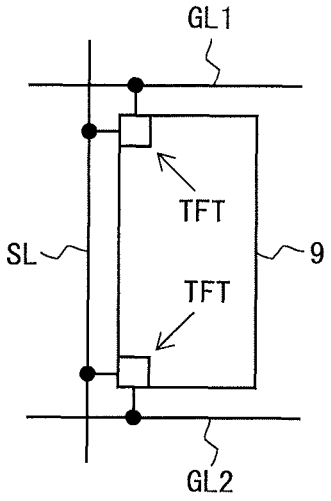
FIG. 15 is a schematic diagram showing a 2G-1D configuration.
Figure 16:
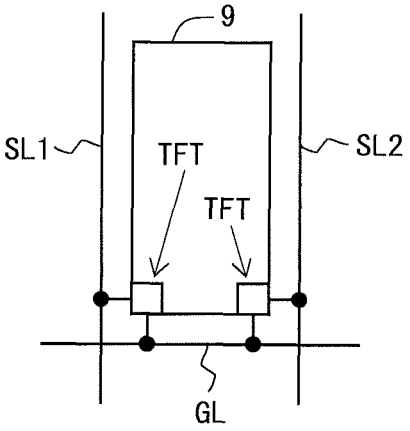
FIG. 16 is a schematic diagram showing a 1G-2 D configuration.

FIG. 14 is a circuit diagram showing the configuration of the stage constituent circuit in the second modified example of the above embodiment. This stage constituent circuit is provided with four thin-film transistors T61 to T64. Further, this stage constituent circuit has four input terminals 61 to 64 and one output terminal 65 besides an input terminal for the low-level DC power supply potential VSS. As for the thin-film transistor T61, a gate terminal is connected to the first node N1, a drain terminal is connected to the input terminal 63, and a source terminal is connected to the output terminal 65. As for the thin-film transistor T62, a gate terminal and a drain terminal are connected to the input terminal 61 (i.e., those are diode-connected), and a source terminal is connected to the first node N1. As for the thin-film transistor T63, a gate terminal is connected to the input terminal 62, a drain terminal is connected to the first node N1, and a source terminal is provided with the DC power supply potential VSS. As for the thin-film transistor T64, a gate terminal is connected to the input terminal 64, a drain terminal is connected to the output terminal 65, and a source terminal is provided with the DC power supply potential VSS. In such a configuration, one of the two-phase clock signals is given to the input terminal 63, and the other of the two-phase clock signals is given to the input terminal 64.

In the present modified example, at a timing (a timing of the time point t12 in FIG. 6) after the output signal Q has been held on the high level just in a predetermined period, a potential of the first node N1 is set to the low level based on the reset signal R. For this reason, after the potential of the first node N1 has been sufficiently increased, the potential of the first node N1 can certainly be decreased to the low level. Further, since a potential of the output terminal 65 is set to the low level based on the clock VCLK2, the potential of the output terminal 65 decreases to the low level every time the clock VCLK2 changes from the low level to the high level. From the above, it is possible to suppress output of an abnormal pulse from the output terminal 65.

DESCRIPTION OF REFERENCE CHARACTERS

100: LIQUID CRYSTAL PANEL
102: DISPLAY SECTION
110L: FIRST GATE DRIVER
110R: SECOND GATE DRIVER
111: FIRST SHIFT REGISTER
112,113: SECOND SHIFT REGISTER
200: DISPLAY CONTROL CIRCUIT
300: SOURCE DRIVER
GL(L1) to GL(Ln): FIRST GATE BUS LINE
GL(R1) to GL(Rn): SECOND GATE BUS LINE
SL1 to SLm: SOURCE BUS LINE
Pix1: FIRST SUB-PIXEL SECTION
Pix2: SECOND SUB-PIXEL SECTION
Gout(L1) to Gout(Ln): SCANNING SIGNAL TO BE APPLIED TO FIRST GATE BUS LINE
Gout(R1) to Gout(Rn): SCANNING SIGNAL TO BE APPLIED TO SECOND GATE BUS LINE
CK1L, CK2L, CKR1, CKR2: CLOCK
S: SET SIGNAL
R: RESET SIGNAL
Q: OUTPUT SIGNAL FROM STAGE CONSTITUENT CIRCUIT

The invention claimed is:

1. A liquid crystal display device, comprising:

a display section;

a pixel section which contains a first sub-pixel section including a first switching element, a first pixel electrode connected to a first conduction terminal of the first switching element, and a first pixel capacitance that stores an electric charge in accordance with a potential of the first pixel electrode, and a second sub-pixel section including a second switching element, a second pixel electrode connected to a first conduction terminal of the second switching element, and a second pixel capacitance that stores an electric charge in accordance with a potential of the second pixel electrode, and forms an n-rows ×m-columns pixel matrix (n and m are natural numbers) in the display section;

first scanning signal lines, provided corresponding to each row of the pixel matrix, and connected to a control terminal of the first switching element;

second scanning signal lines, provided corresponding to each row of the pixel matrix, and connected to a control terminal of the second switching element;

video signal lines, provided corresponding to each column of the pixel matrix, and connected to a second conduction terminal of the first switching element and a second conduction terminal of the second switching element;

a first scanning signal line drive circuit that drives the first scanning signal lines, a second scanning signal line drive circuit that drives the second scanning signal lines, and a video signal line drive circuit that drives the video signal lines, wherein the display section, the first scanning signal line drive circuit, and the second scanning signal line drive circuit are monolithically formed on one substrate, the first scanning signal line drive circuit has a first shift register configured by a plurality of stages which contain stages corresponding to each of the first scanning signal lines, the first shift register outputs scanning signals that are sequentially set to an on-level one by one from the plurality of stages based on a first clock signal group as two-phase clock signals whose phases are shifted by 180 degrees from each other, the second scanning signal line drive circuit has a second shift register configured by a plurality of scanning signal output stages and a plurality of dummy stages, the scanning signal output stages containing stages corresponding to each of the second scanning signal lines, the dummy stages being provided J by J (J is a natural number) between any two scanning signal output stages which are adjacent to each other, the second shift register outputs scanning signals that are sequentially set to the on-level one by one from the plurality of scanning signal output stages based on a second clock signal group as two-phase clock signals whose phases are shifted by 180 degrees from each other, and a frequency of the second clock signal group is made J+1 times as large as a frequency of the first clock signal group.

2. The liquid crystal display device according to claim 1, wherein the dummy stages are provided one by one between any two scanning signal output stages which are adjacent to each other.

3. The liquid crystal display device according to claim 1, wherein the first scanning signal line drive circuit is provided on one end side of the display section in a direction in which the first scanning signal lines and the second scanning signal lines extend, and the second scanning signal line drive circuit is provided on the other end side of the display section in the direction in which the first scanning signal lines and the second scanning signal lines extend.

4. The liquid crystal display device according to claim 1, wherein each stage constituting the first shift register and the second shift register includes an output node for outputting a scanning signal, an output control switching element having a second conduction terminal being connected to the output node, a first node connected to a control terminal of the output control switching element, a first node turn-on switching element having a second conduction terminal being connected to the first node, and a control terminal and a first conduction terminal to which an output signal from the output node of a preceding stage is given, and an output node turn-off switching element having a first conduction terminal being connected to the output node, a second conduction terminal to which an off-level potential is given, and a control terminal to which an output signal from the output node of a subsequent stage is given, either of the two-phase clock signals included in the first clock signal group is given to the first conduction terminal of the output control switching element in the first shift register, and either of the two-phase clock signals included in the second clock signal group is given to the first conduction terminal of the output control switching element in the second shift register.

* * * * *